US010480150B2

(12) United States Patent
Ladkat

(10) Patent No.: US 10,480,150 B2
(45) Date of Patent: Nov. 19, 2019

(54) RETAINING WALL METHOD OF PRECAST BLOCK TO PREVENT LANDSLIDE

(71) Applicant: Rajendra Vithal Ladkat, Maharashtra (IN)

(72) Inventor: Rajendra Vithal Ladkat, Maharashtra (IN)

( * ) Notice: Subject to any disclaimer, the term of this patent is extended or adjusted under 35 U.S.C. 154(b) by 0 days.

(21) Appl. No.: 15/551,657

(22) PCT Filed: Feb. 19, 2016

(86) PCT No.: PCT/IN2016/000045

§ 371 (c)(1),
(2) Date: Aug. 17, 2017

(87) PCT Pub. No.: WO2016/132380

PCT Pub. Date: Aug. 25, 2016

(65) Prior Publication Data

US 2018/0023267 A1 Jan. 25, 2018

(30) Foreign Application Priority Data

Feb. 21, 2015 (IN) ..... 2677/MUM/2014

(51) Int. Cl.
*E02D 29/02* (2006.01)

(52) U.S. Cl.
CPC ..... *E02D 29/025* (2013.01); *E02D 29/02* (2013.01); *E02D 29/0216* (2013.01); *E02D 29/0233* (2013.01); *E02D 29/0266* (2013.01)

(58) Field of Classification Search
CPC combination set(s) only.
See application file for complete search history.

(56) References Cited

U.S. PATENT DOCUMENTS 4,470,728 A * 9/1984 Broadbent ..... E02D 29/0266 405/284
4,932,812 A * 6/1990 Schaaf ..... E02D 29/025 405/284
5,122,015 A * 6/1992 Shen ..... E02B 3/14 405/284
5,507,127 A * 4/1996 Gates ..... E04C 1/40 241/DIG. 31
5,622,456 A * 4/1997 Risi ..... E02D 29/025 405/262
5,647,185 A * 7/1997 Forlini ..... E04B 2/06 405/284

(Continued)

FOREIGN PATENT DOCUMENTS

KR 101391238 B1 * 5/2014
KR 20140124603 A * 10/2014

*Primary Examiner* — Kyle Armstrong
(74) *Attorney, Agent, or Firm* — Rosenberg, Klein & Lee

(57) ABSTRACT

A precast H block (3) interlock each other to form sloping wall and similarly precast Y block (10) interlock each other to form straight wall, both block having a pin hole (4) through side walls. A wire rope (5) passing through said pin hole to make a wall strengthened by nailing horizontally (14) into the earth (8) adjacent to the block and vertically nailing (9) at top and bottom level. As well as wire rope (5) passing through said pin hole (4) of uppermost blocks, from underneath the road, to make a wall/barrier strengthened by nailing vertically (9) into the earth across the road (2).

8 Claims, 6 Drawing Sheets

(56) References Cited

U.S. PATENT DOCUMENTS

| | | | | |
|---|---|---|---|---|
| 5,921,715 | A * | 7/1999 | Rainey | E02D 29/0225 405/262 |
| 6,052,772 | A * | 4/2000 | Kark | G06F 13/1605 711/151 |
| 6,089,792 | A * | 7/2000 | Khamis | E02D 29/0225 405/262 |
| 2008/0229698 | A1* | 9/2008 | Ulguner | E02D 29/0266 52/608 |
| 2009/0191010 | A1* | 7/2009 | King | B28B 7/0079 405/286 |
| 2011/0110728 | A1* | 5/2011 | Kim | E02D 29/0225 405/284 |
| 2011/0286795 | A1* | 11/2011 | Barrett | E01C 1/00 404/72 |
| 2011/0318100 | A1* | 12/2011 | Rainey | E02D 29/025 404/6 |
| 2014/0026511 | A1* | 1/2014 | Binns | E02D 29/025 52/565 |
| 2015/0197895 | A1* | 7/2015 | Singh | E01C 1/04 405/259.5 |

* cited by examiner

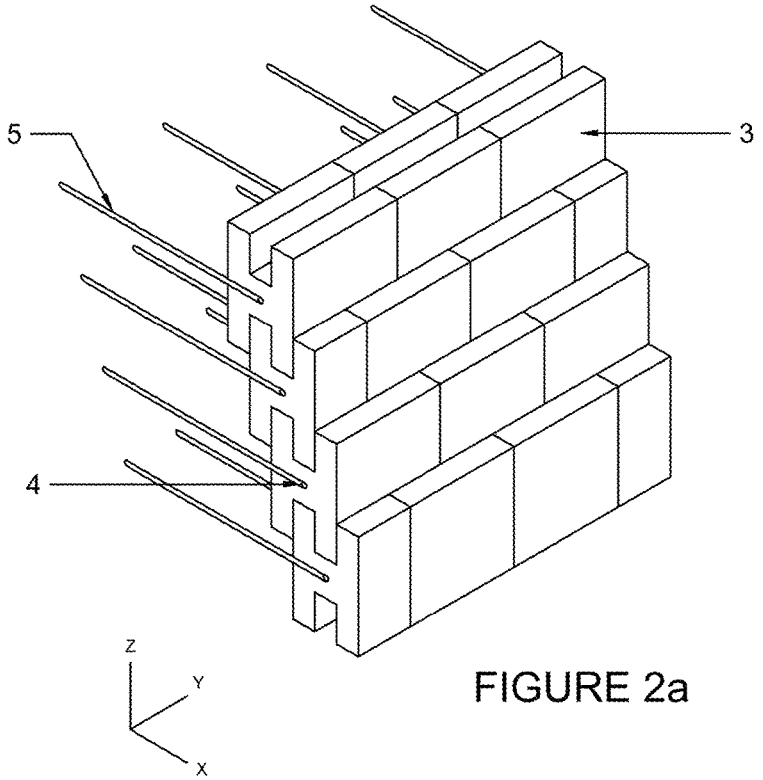
FIGURE 2a
FIGURE 2b
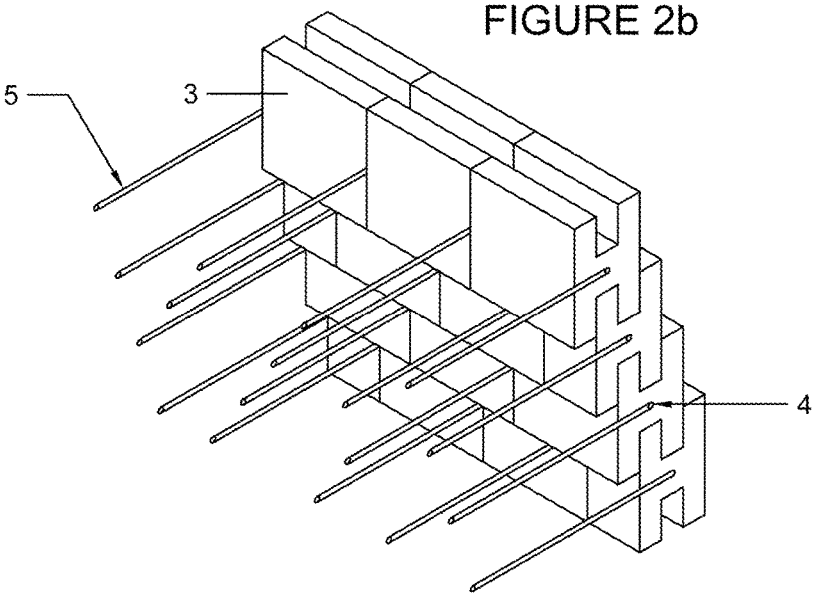

RETAINING WALL METHOD OF PRECAST BLOCK TO PREVENT LANDSLIDE

FIELD OF THE INVENTION

This invention relates to landslide prevention and retaining wall in Mountain pass for accident prevention.

BACKGROUND OF INVENTION

The earliest engineering attempts at landslide correction likely occurred at railroad and canal embankments in England and France, in the beginning of the 1830s. From 1850 to 1950, most cut slopes were excavated at slopes of 1:1 or steeper, and fill was placed on embankments of about 1.5:1 (horizontal to vertical). Steeper embankments were accommodated by stacking rock or masonry blocks to create gravity retaining walls, then filling 1.5:1 above such structures.

Failed excavations were simply laid back to a more stable inclination. In more urbanised or mountainous areas, where there was little available right of way, concrete and masonry gravity retaining walls were most often employed.

By the 1930s, most landslide repairs consisted of either partial excavation of the head scrap area and/or the placement of toe buttresses, most commonly over existing creeks or gullies.

By the mid 1940s, sheepsfoot compactors began to be employed for so-called "dry" compaction of large earth embankments and rock-filled dams.

By the late 1950s, a new style of repair came onto the scene, known by most practitioners as the "recommended buttress fill". This remains the most commonly used method of landslide repair in the United States.

A variety of retention structures have been successfully employed to repair land slippage where high value structures are inextricably involved with repair. The types of structures are basically divisible into four main categories:

(1) gravity structures; (2) cantilever structures; (3) flexible and/or bulkhead walls: (4) retained structures: in addition, combination structures can incorporate one or more of the methods.

Various types of gravity retention structures that depend upon their sheer mass as a resisting force to the load imposed by hillside. This is the earliest type of retention structure, having been used by Assyrians and Egyptians beginning around 2900 BC. Examples: stacked masonry, rubble filled masonry, rock filled gabions, timbre or concrete crib wall, multiple depth crib wall, steel bin wall, concrete buttress wall or braced wall, geogrid shear key or reinforced soil embankments.

Various types of cantilever retention structures came into use with the advent of pile driving, which dates back to roman times. The use of large-diameter augers allows such structures to be constructed in stiff soils and soft rock. Examples: masonry block or steel block, reinforced concrete cantilever, inside stem wall, reverse stem wall, pier supported reinforced concrete walls, cast-in place reinforced concrete piers with inter-connecting grade beam, h-pile wall, cast in place caissons with interconnecting under-ream cones.

Various types of retained structures—those employing tension elements. The cost and feasibility of such structures is almost wholly dependent on drill rig access and drill ability of the ground. Examples: screw anchors, dead man anchor, drilled tie back or tendon, reaction pier tieback, pressure grout bulbs in soft soils, rock bolt.

Various types of flexible retention structures, or those that deflect in order to shed their imposed loads. Such deflection lessens wall loads by allowing the ground mass to mobilise its shear strength (Rankine active-pressure theory). Examples: loffel block wall, sackrete wall.

The loffelstein, or loffelblock retaining wall is a design concept emanating from Austria, and is now produced in the United States. Its primary application is for slopes under 22 ft high with an angle of internal friction, angle greater than 30 degrees. In the case shown, the wall was constructed on a 20% longitudinal gradient to support a highway cutslope.

Various types of sub drainage measures are used by geotechnical practitioners like collector gallery method, interceptor drain drilled through bottoms to collect discharge.

Geogrid reinforced repair scheme have a wide array of grid strengths is now available, as are competitive products manufactured by Tenax and Nicolon. Embodiment lengths generally vary from 1 to 1.5 times the embankment height. The employment of prefabricated drainage membranes at the heel of keyways helps to speed up the jobs with steep grades and tight working areas. The grids provide much for hydroseeding, much like jute mesh. As an alternative to face wrapping, intervening layers of geogrid can be placed at the slope heights on the order of 1 ft.

Geogrids with reno/revetment mattress and reinforced concrete footing w/continuous cut-off wall or geogrids placed at 12 degree spacings with concrete gabion footing steel sheet pile cut-off wall. Geogrids can also be used with loffel block or keystone combination.

Wire bins can be used as facing elements for geogrid-reinforcement embankments and/or retention structures.

U.S. Pat. No. 5,549,420 A invention relates a retaining wall functioning both as a gravity-type retaining wall and as a leaning-type retaining wall is constructed on a sloped cut earth surface for the prevention of landslide. The retaining wall includes a bottom surface defined by a horizontal portion of the cut earth surface and having a transverse length of $L_2$, a top surface opposite the bottom surface and having a transverse length of $L_1$ which is greater than $L_2$, an outside surface extending generally vertically between the top and bottom surfaces, and an inclined surface opposite the outside surface and defined by the cut earth surface. The retaining wall has the centre of gravity at a position so that part of the weight of the wall is imposed upon the sloped portion of the cut earth surface.

EP 0512932 B1 invention relates to the general technical field of building and implementation of construction works made from prefabricated modular elements assembled dry. The invention relates to a prefabricated modular element with the stack in dry bunk allows the realization of construction works, of the type retaining structures submerged or of any type, such as, for example, walls, dikes, quay walls, riprap, floors, pavements.

The invention also relates to works made from modular prefabricated and dry erection process of the construction work.

To make retaining structures or submerged, such as those mentioned above, it is known to use prefabricated building elements, the modular type, consisting usually of reinforced concrete or not intended to be placed on singing bunk beds.

U.S. Pat. No. 7,524,144 B2 invention relates a concrete block structure useful in forming a retaining wall having upwardly open openings to facilitate planting plants therein. The block has an upright front wall, laterally spaced side walls joined to the front wall, and an upwardly open interior, the side walls having upwardly open and laterally aligned grooves formed in them, and a rod received within the grooves and protruding laterally beyond each side wall. A flexible anchor sheet having a forward edge portion may extend along and above at least two adjacent blocks of the course, the anchor sheet being attached to the rod and extending rear worldly over an upper surface of the rear wall for anchoring reception in an embankment against which the blocks are placed.

U.S. Pat. No. 8,272,812 B2 invention relates retaining wall building blocks for receiving fill material during construction of a retaining wall, retaining walls constructed with the building blocks and methods of manufacture of the building block wherein the block comprises a cast cement body having a base, a generally upright face wall extending upward from the base, two generally upright side walls extending upward from the base and generally rearward of the face wall, the base, upright face wall, and side walls each having an inner and an outer surface, the side walls each having a top and a rearward most end, and a fill receiving cavity defined by base inner surface, side wall inner surfaces and face wall inner surface for receiving fill material, the fill receiving cavity having a volume wherein a ratio of the volume of the fill receiving cavity to the volume of the retaining wall building block is at least 0.75:1, respectively.

Accordingly, to the above said patents and existing solutions, there are disadvantages like high assembly time, low cost effectiveness, or cracking of walls which when repaired do not retain strength and structural integrity. The blocks are of a complex shape which increases die cost and manufacturing time. The keys of the keystones have low cross-section area hence easily broken by shear forces thus the whole wall becomes prone to collapsing when the load of the land-slide is acting on them.

Hence there was felt a need for an efficient retaining wall system which can overcome the disadvantages of the prior art and provide more effective retaining wall system.

OBJECT OF THE INVENTION

To reduce the incidences of landslides,

To reduce the frequent widening of roads and excavation of mountains caused due to natural and manmade disasters, To resist maximum impact of the landslide, To reduce deforestation caused due to road widening, To reduce the clogging and flooding of rivers caused due to landslide debris, To reduce the construction time of retaining walls by using pre-casted blocks, To prevent incidences of vehicles falling into valleys on roads with narrow turnings by building a well protected wall, To act as a multipurpose protective wall on sides of road lying in mountains, flood prone areas, riversides, dams, canals, railway tracks, highways, buildings and houses near steep slopes, etc, To provide a retaining wall with a long life, To overcome the height limitations of the existing precast block, To save on the labour costs, To protect the ecosystem, To provide with an effective solution using reusable blocks and wire ropes.

SUMMARY OF THE INVENTION

A retaining wall method of precast block to prevent landslide, said method comprising:

a. a precast H shape block to construct sloping wall and Y shape for constructing straight wall, having a pin hole through side wall b. a wire rope passing through said pin hole to make a wall strengthened by nailing horizontally, into the earth adjacent to the block c. a wire rope passing through said pin hole of uppermost blocks, from underneath the road, to make a wall/barrier strengthened by nailing vertically into the earth across the road d. a wire rope passing through the said pin hole of the lowermost blocks is nailed vertically into the earth e. a wire rope passing through said pin holes of the vertically interlocking wall and through the pin holes of the opposite vertically interlocking wall to form loops of wire ropes/straps so that the H blocks opposite to each other hold each other firmly to form road/rail track

BRIEF DESCRIPTION OF THE FIGURES

Other aspects of the invention will become apparent by consideration of the accompanying drawings and their description stated below, which is merely illustrative of a preferred embodiment of the invention and do not limit in any way the nature and scope of the invention.

FIG. 2 shows the schematic diagram of the wall made by H blocks.

DETAILED DESCRIPTION

Figure 1:
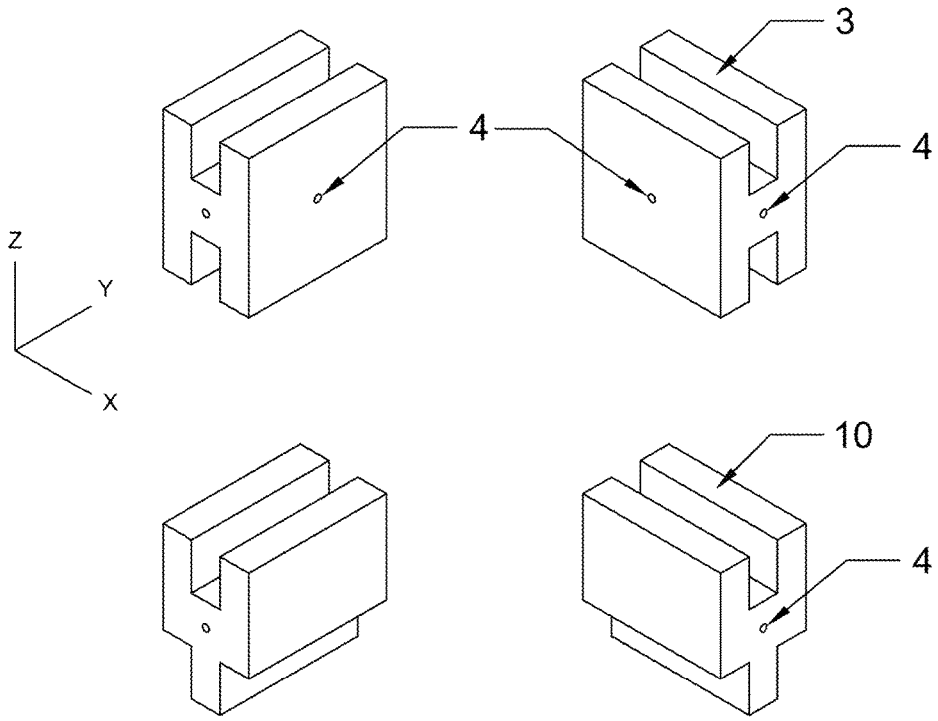
FIG. 1 illustrates the isometric view of the H and Y blocks.

The invention will now be described with reference to the accompanying drawing which does not limit the scope and ambit of the invention. The description provided is purely by way of example and illustration Referring to the accompanied drawing a retaining wall method of precast blocks to prevent landslide in accordance with this invention is generally indicated by the reference numeral 17 and is particularly shown in FIG. 3, FIG. 4, FIG. 5 and FIG. 6 of the drawing.

FIG. 1 illustrates precast H and Y blocks made from reinforced concrete or any other suitable material. The H (3) or Y block (10) has two hollow pipes (4) passing through the vertical and horizontal centre, in both, the XZ and YZ plane. Ropes (5) pass through these holes for nailing purpose. The H blocks (3) interlock in each other vertically, to form a sloping wall, while the Y blocks (10) interlock vertically to form a straight wall. The depth of the central groove is ⅓ the total height of the block, and its width is ⅓ the total width of the block.

FIG. 2 illustrates the H blocks (3) interlocked vertically to form a sloping wall. Ropes (5) pass through the XZ plane, and are nailed in the YZ plane.

When we need there to be no gaps (here, along Y axis) between two blocks we can pass a rope through the hole in the centre of the block that is in the YZ plane through its entire width, along +X axis, and pass it through the same hole of the adjacent block, along −X axis, and nail the two ends in YZ plane.

Figures 3A, 3B:
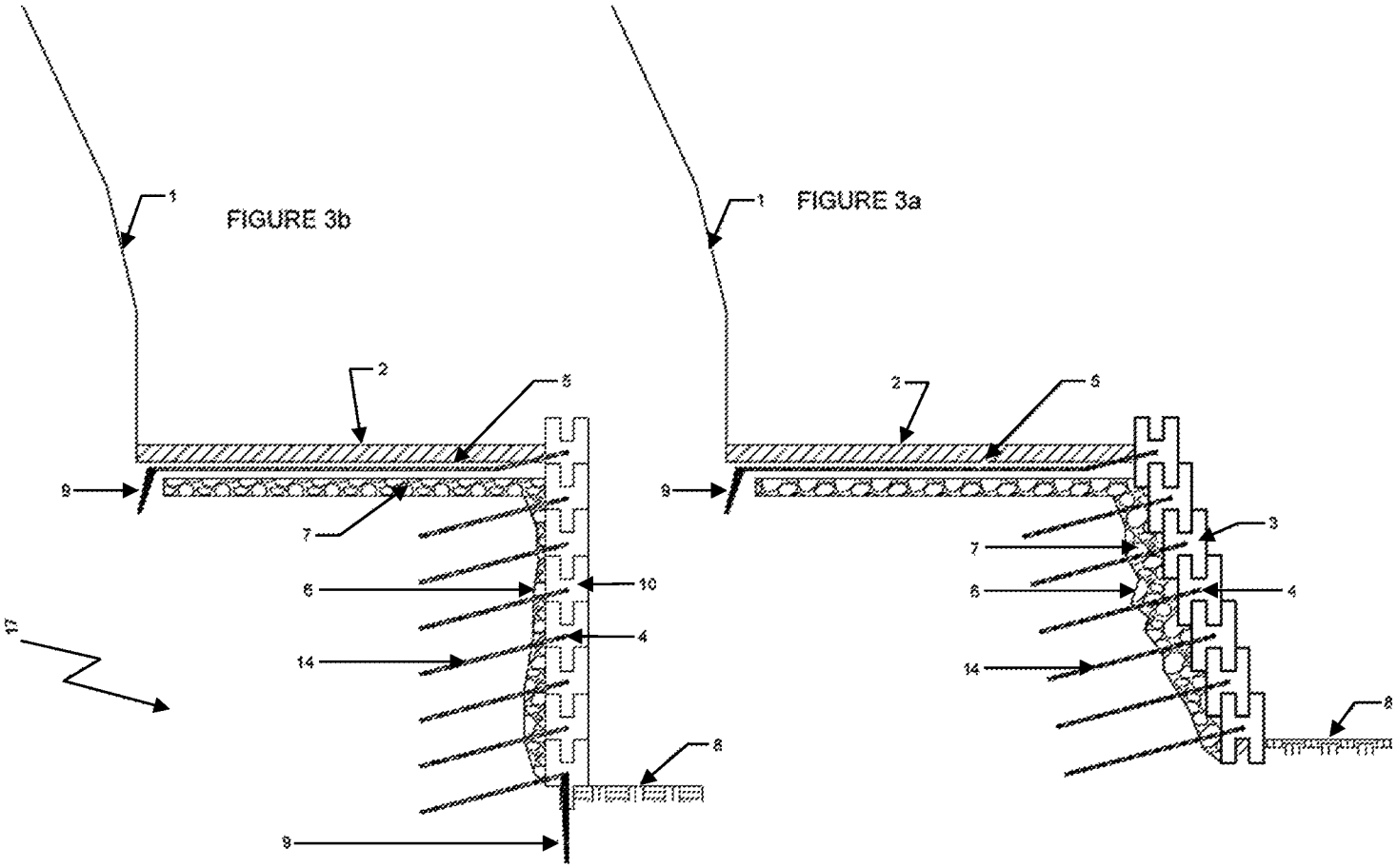
FIG. 3 illustrates the cross-sectional diagram showing the application of H block for landslide and accident prevention.

FIG. 3 illustrates the cross-section of a hill/mountain range (1), and a road (2). The H blocks (3) are nailed horizontally (14) into the earth so that it holds the gravel (7). The uppermost layer of H blocks however, is nailed vertically (9) into the earth with help of wire ropes/straps (5), across the road (2), from underneath it. This upper layer of H blocks (3) acts as the safety barrier that prevents the vehicles from crashing into the valley in case of accidents. Since the weight of the vehicle is acting on the ropes (5) passing from under the road, the desired support is acquired and it is highly unlikely for the vehicles to break through the blocks, into the valley. The lower two limbs of the upper H block interlocks with the upper two limbs of the lower H block, forming four layers of RCC precast material. The impact of the vehicles is absorbed by the initial layers and the remaining layers reduce the vehicle's momentum. Also, the impact gets transmitted through the ropes/straps (5) into the road (2), and into the earth (8) through the vertical nailing (9) across the road (2), as well as through the vertical (9) and horizontal (14) nailing adjacent to the said H blocks (3).

Such design of sloping blocks is being created to prevent pressure of landslide instead of straight vertical wall. Straight vertical wall cannot resist as much pressure as sloping H blocks (3). Each of the H block (3) has a circular hollow pipe (4) penetrating throughout the block which consist of steel wire rope (5) passing through every H block (3) in the row. This steel wire rope (5) is attached to the threaded pile which is being inserted deep inside the earth, thus supporting the H blocks. The thickness of the wire rope (5) depends upon pressure on each block and risk of the landslide considering height and slope of mountain (6). The threaded pile is also inserted vertically (9) into the earth increasing the firmness of the lowermost H blocks (3). Certain gap is being created due to thickness of wire rope (5) which is being looped around the wire that is passing through two H block (3). This gap also allows the excess ground water flow thus reducing the pressure on the block. It also acts like a screen which allows the flow of water and restricts the flow of pebbles/gravel (7).

If the hill slope (6) is gradual, H blocks are used (3*a*), whereas, if it is steep, Y blocks are used (3*b*). For varying slopes, a combination of H(3) and Y (10) blocks can be used. Also, the width and height of the H block (3) and its groove can be customised depending on the slope.

Figure 4:
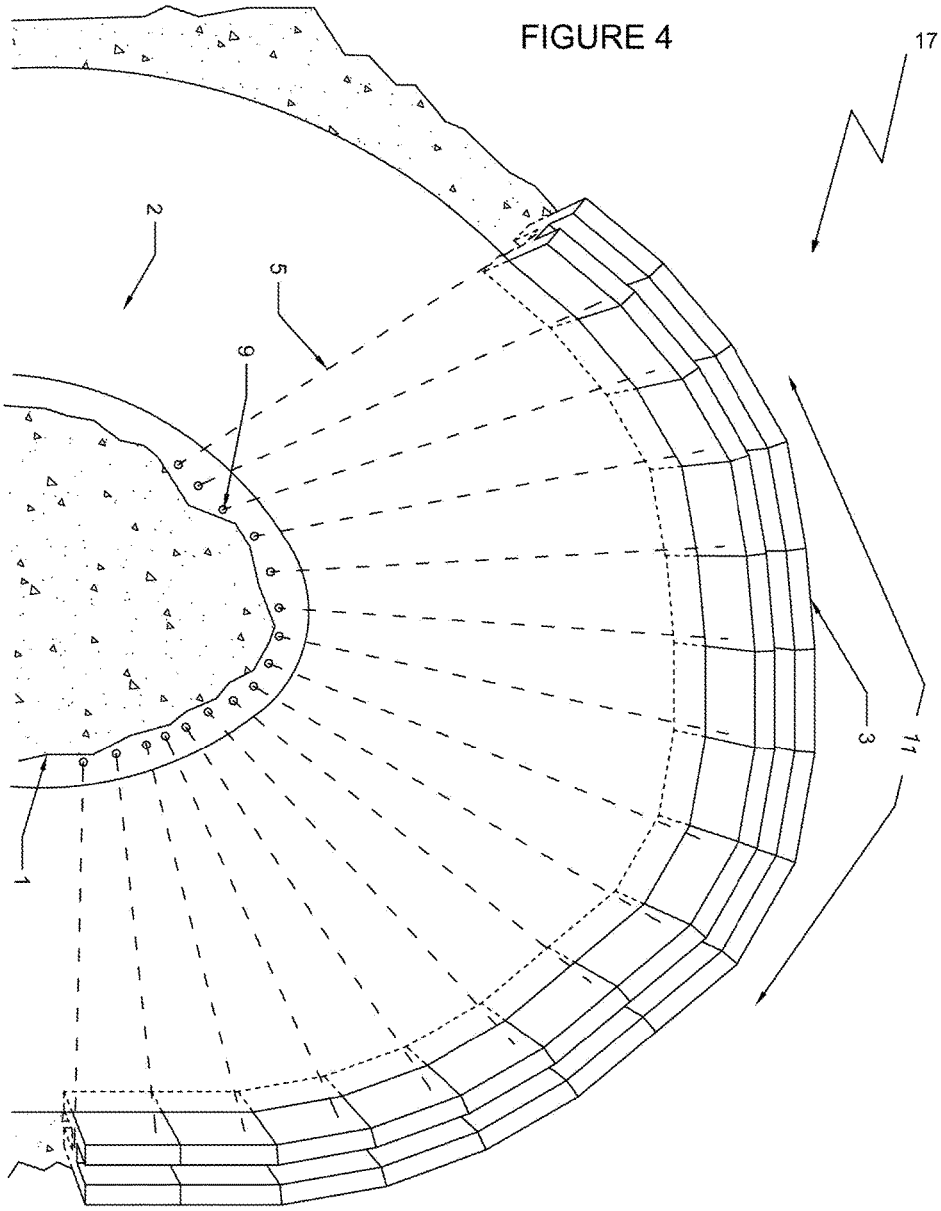
FIG. 4 shows a Top view of the application of H blocks along turns in mountain pass.

FIG. 4 illustrates the turns along in the mountain (1) pass the blocks are cast with sides at an angle so as to get a curved wall (11) when placed adjacently. This prevents vehicles from falling in the valley in the most accident prone areas i.e. on the turns. The ropes (5) pass across the road (2) from underneath it (9) for desired support. The impact of the vehicles is absorbed by the initial layers and the remaining layers reduce the vehicle's momentum. Also, the impact gets transmitted through the ropes/straps (5) into the road (2), and into the earth (8) through the vertical nailing (9) across the road (2), as well as through the vertical (9) and horizontal (14) nailing adjacent to the said H blocks (3).

Figure 5:
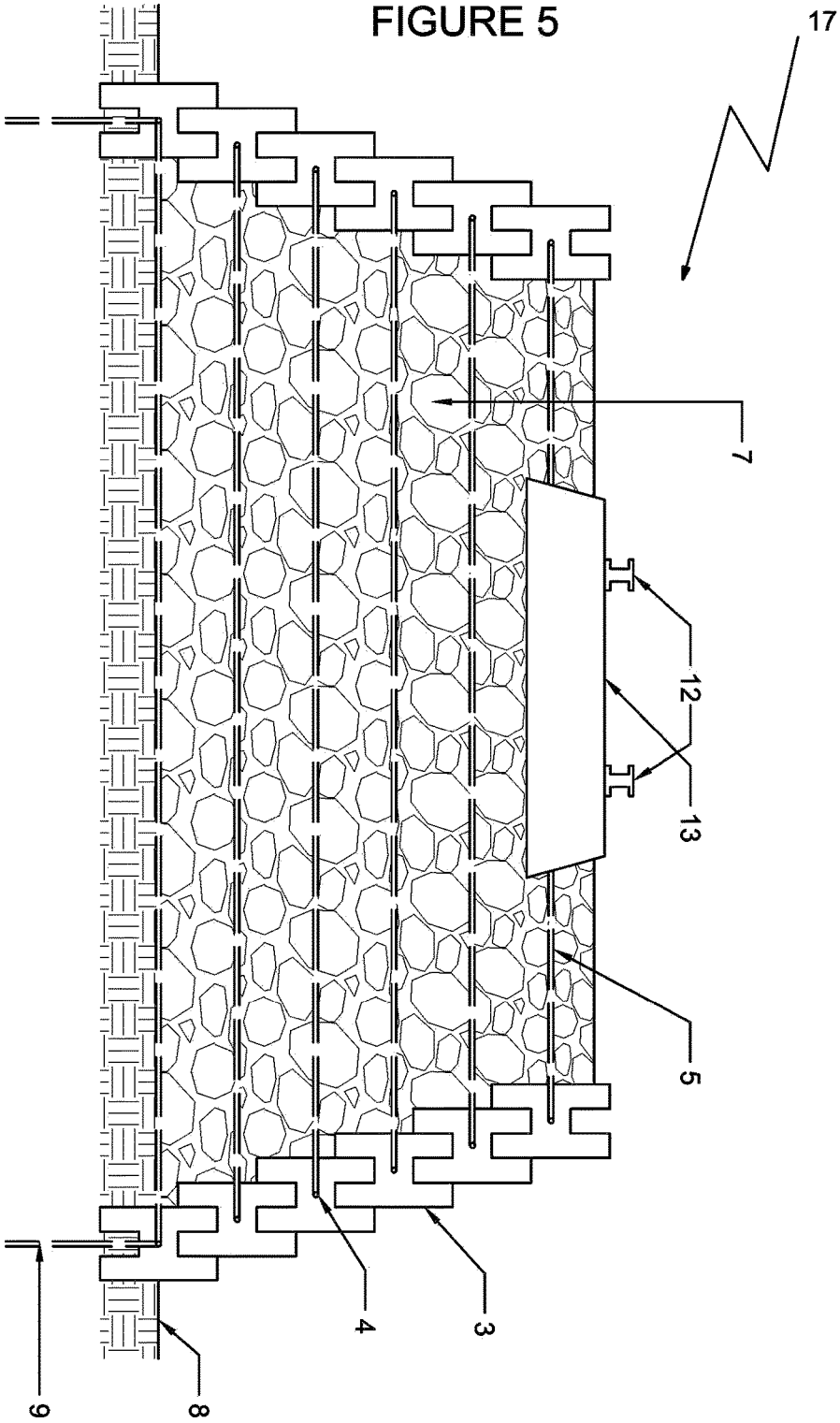
FIG. 5 illustrates a cross-sectional view of a railroad using precast H block

FIG. 5 illustrates retaining walls made of interlocking H-blocks (3) are placed opposite to each other at a distance. The space between these walls is filled with stone gravel (7). The blocks opposite to each other are tied together with a rope/strap (5) passing through said pinholes (4) that forms a loop. Each pair of opposite blocks are tied for the entire length of the rail (12) & rail sleeper (13) and the lowermost blocks are nailed vertically (9) downwards into the earth (8).

Figure 6:
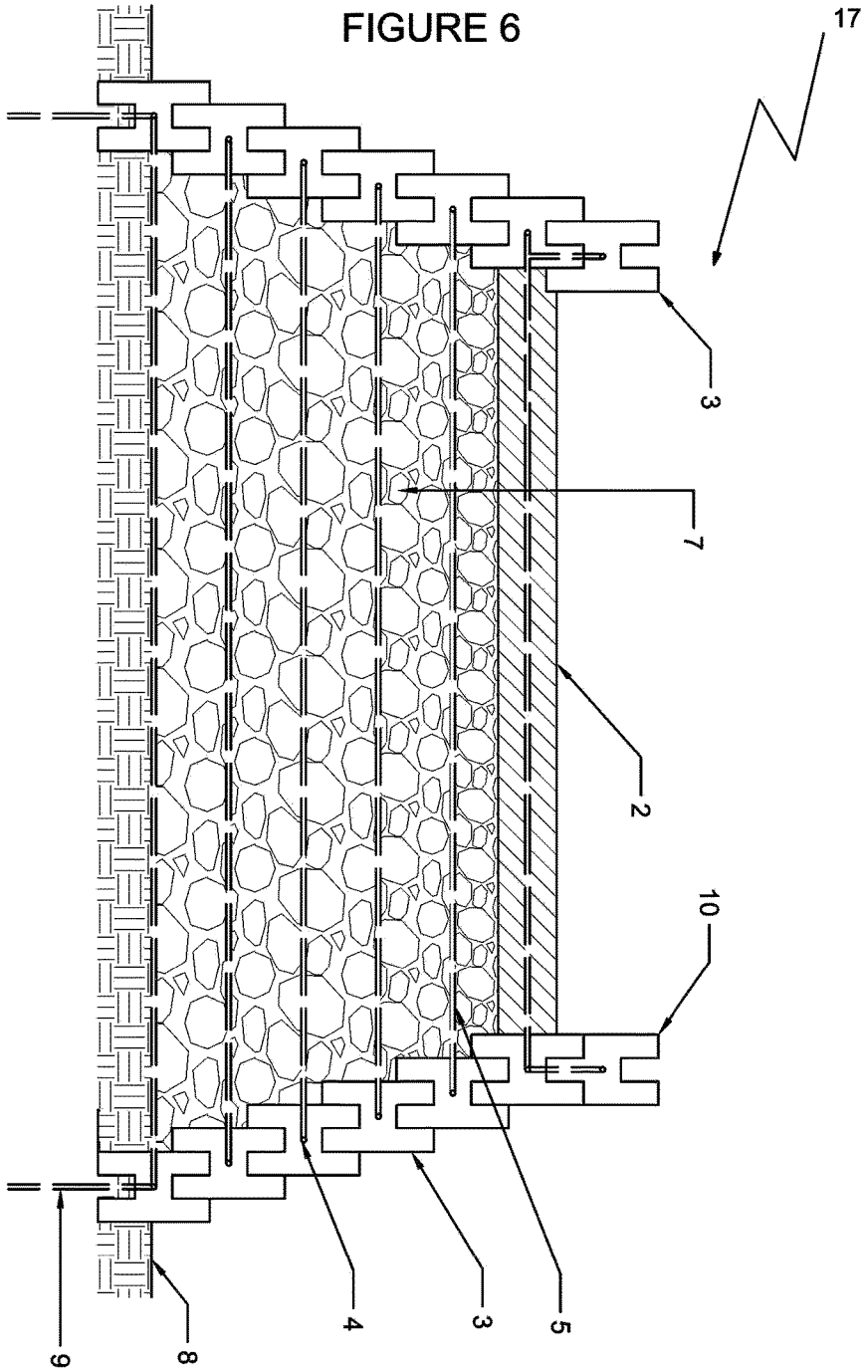
FIG. 6 shows a cross-sectional view of a road using precast H block and Y block

FIG. 6 illustrates the retaining walls made of interlocking blocks are placed opposite to each other at a distance. The space between these walls is filled with stone gravel (7). The blocks opposite to each other are tied together with a rope (5) passing through said pinholes (4) that forms a loop. Each pair of opposite blocks are tied for the entire length of the road (2) and the lowermost blocks are nailed vertically (9) downwards into the earth (8). The uppermost H-blocks (3) are interlocked with Y-blocks (10)/H-blocks (3) that act as safety barriers for road traffic.

What is claimed is:

1. A method for retaining a wall of precast blocks to prevent landslide, said method comprising the steps of:

placing a plurality of precast blocks in a layered interlocking relation with each other to form said wall based on configuration of the plurality of precast blocks, wherein each precast block of said plurality of precast blocks has a pin hole located at center of a side wall of the precast block and extending there through;

passing a wire rope through said pin hole of each precast block of said plurality of precast blocks and securing said wire rope to earth adjacent to said each of the plurality of precast blocks for strengthening said wall, wherein said wire rope is secured to the earth by attaching said wire rope to a threaded pile being inserted horizontally inside the earth; and passing the wire rope, of each precast block of a first set of precast blocks selected from the plurality of precast blocks, across a road from underneath the road to insert the threaded pile attached with said wire rope, of each precast block of a first set of precast blocks, vertically inside the earth.

2. The method as claimed in claim 1, wherein said plurality of precast blocks have an H shaped configuration or a Y shaped configuration.

3. The method as claimed in claim 2, wherein said plurality of precast blocks having said H shaped configuration are used to construct the sloping walls, and said plurality of precast blocks having said Y shaped configuration are used to construct the vertical walls.

4. The method as claimed in claim 1, wherein said plurality of precast blocks are made from a material selected from a group consisting of reinforced concrete, concrete, mild steel, steel, steel fibre, stone, any type of sand, rubber, and plastic.

5. The method as claimed in claim 1, wherein the first set of precast blocks are part of uppermost layer of the layered interlocking relation of the side wall.

6. The method as claimed in claim 1, wherein the threaded pile attached to the wire rope of each precast block, of a second set of precast blocks selected from the plurality of precast blocks, is inserted vertically inside the earth.

7. The method of claim 6, wherein the second set of precast blocks are part of lowermost layer of the layered interlocking relation of the side wall.

8. The method of claim 1, wherein the wire rope securing each of the plurality of precast blocks to the earth is passed through a corresponding opposite precast block, said opposite precast block being part of another wall formed parallel to said wall.

* * * * *